US008555977B2

(12) United States Patent
Aykens

(10) Patent No.: US 8,555,977 B2
(45) Date of Patent: Oct. 15, 2013

(54) REMOTELY OPERATED UNDERWATER REDIRECTION PLENUM CHAMBER FOR SPILL RESPONSE

(75) Inventor: John David Christopher Aykens, Port Orchard, WA (US)

(73) Assignee: Blueshift, Inc., Port Orchard, WA (US)

( * ) Notice: Subject to any disclaimer, the term of this patent is extended or adjusted under 35 U.S.C. 154(b) by 263 days.

(21) Appl. No.: 12/914,904

(22) Filed: Oct. 28, 2010

(65) Prior Publication Data

US 2012/0103620 A1 May 3, 2012

(51) Int. Cl.
*E21B 43/013* (2006.01)
*E21B 41/04* (2006.01)

(52) U.S. Cl.
USPC ..... 166/344; 166/335; 166/345

(58) Field of Classification Search
CPC ..... E21B 43/0122
USPC ..... 166/367, 364, 335, 363, 345
See application file for complete search history.

(56) References Cited

U.S. PATENT DOCUMENTS 4,339,000 A * 7/1982 Cronmiller ..... 166/295
4,568,220 A * 2/1986 Hickey ..... 405/60
5,121,793 A * 6/1992 Busch et al. ..... 166/79.1

* cited by examiner

*Primary Examiner* — Matthew Buck
*Assistant Examiner* — James Sayre
(74) *Attorney, Agent, or Firm* — Lane Powell PC; Priya Sinha Cloutier

(57) ABSTRACT

Remotely operated underwater redirection plenum chamber for spill response. A method for operating an underwater redirection plenum chamber including aligning a first end of the redirection plenum chamber with a riser pipe having a fluid flow. A collar is lowered from the first end of the redirection plenum chamber, such that an inner diameter of the collar surrounds an outer diameter of the riser pipe. A plurality of barbs within the collar are activated to pierce and engage an inner surface of the riser pipe. A grip engages the outer diameter of the riser pipe. The grip has at least two counter rotating cylinders such that when rotated by the fluid flow the counter rotating cylinders create a seal allowing fluid to travel through the grip and into a first chamber of the redirection plenum chamber.

21 Claims, 5 Drawing Sheets

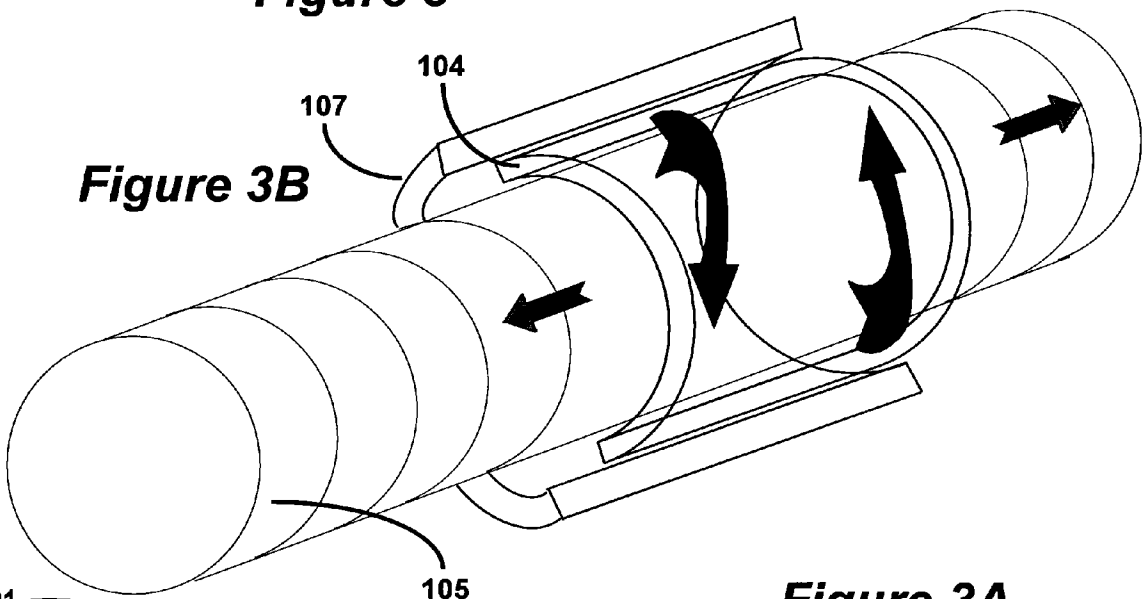
Figure 3
Figure 3B
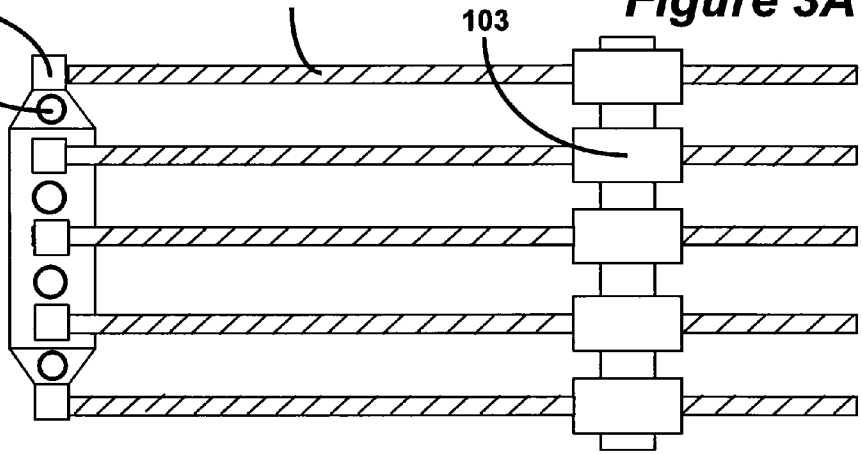
Figure 3A
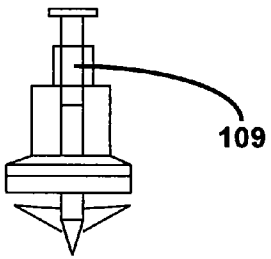
Figure 3C
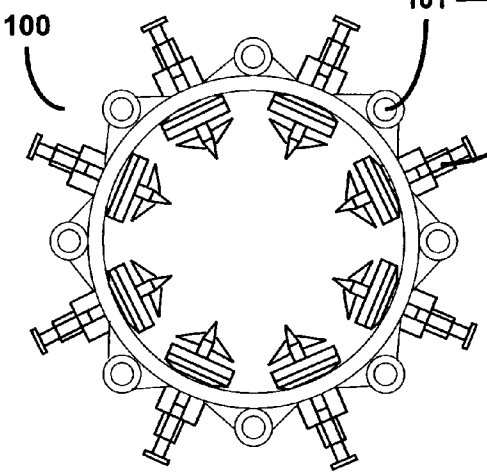
Figure 3D

REMOTELY OPERATED UNDERWATER REDIRECTION PLENUM CHAMBER FOR SPILL RESPONSE

BACKGROUND OF THE INVENTION

Well drilling is a complex science and if done incorrectly can result in disaster. As oil exploration reaches deeper levels, as shown in the recent Deepwater Horizon disaster, the depth of the well creates extreme pressures causing known drilling methods to fail. (For example, using a cement plug or the ability to sheath a pipe with cement). When these known methods fail, the well itself may not be in the proper condition to install either a conventional cap or blowout preventer.

In the Deepwater Horizon disaster, a blowout preventer, a set of valves which sits on the sea floor at the top of the MC252 well, which was drilled by the ill-fated rig, Deepwater Horizon, was riddled with leaks. Originally the preventer was linked to the Deepwater Horizon by a mile long vertical pipe called a riser, through which oil would flow. When the Deepwater Horizon sank, this riser collapsed and folded in on itself, but did not sheer off from the blowout preventer. As a result, much of the leaking oil would flow out of the blowout preventer and into the twisted riser, from which it emerges about 300 meters (1,000 feet) away.

To effect a stoppage of the oil emanating from the blowout preventer, a cofferdam was lowered over the riser extending from the top of the blowout preventer to direct the leaking oil flow straight up to the surface through a new riser lowered from a drillship. Unfortunately, simply trapping the oil coming out of the end of the riser failed because of icy hydrates formed in the cofferdam by the gas coming out of the well. No means exists in the art to exploit the riser itself as a part of a physical fixation of a cofferdam to contain and redirect oil through a riser system for collection at the surface.

BRIEF DESCRIPTION OF THE DRAWINGS

Preferred and alternative examples of the present invention are described in detail below with reference to the following drawings:

FIGS. 3A-D show various views of an attachment system according to an embodiment of the invention;

DETAILED DESCRIPTION OF THE PREFERRED EMBODIMENT

Figure 1:
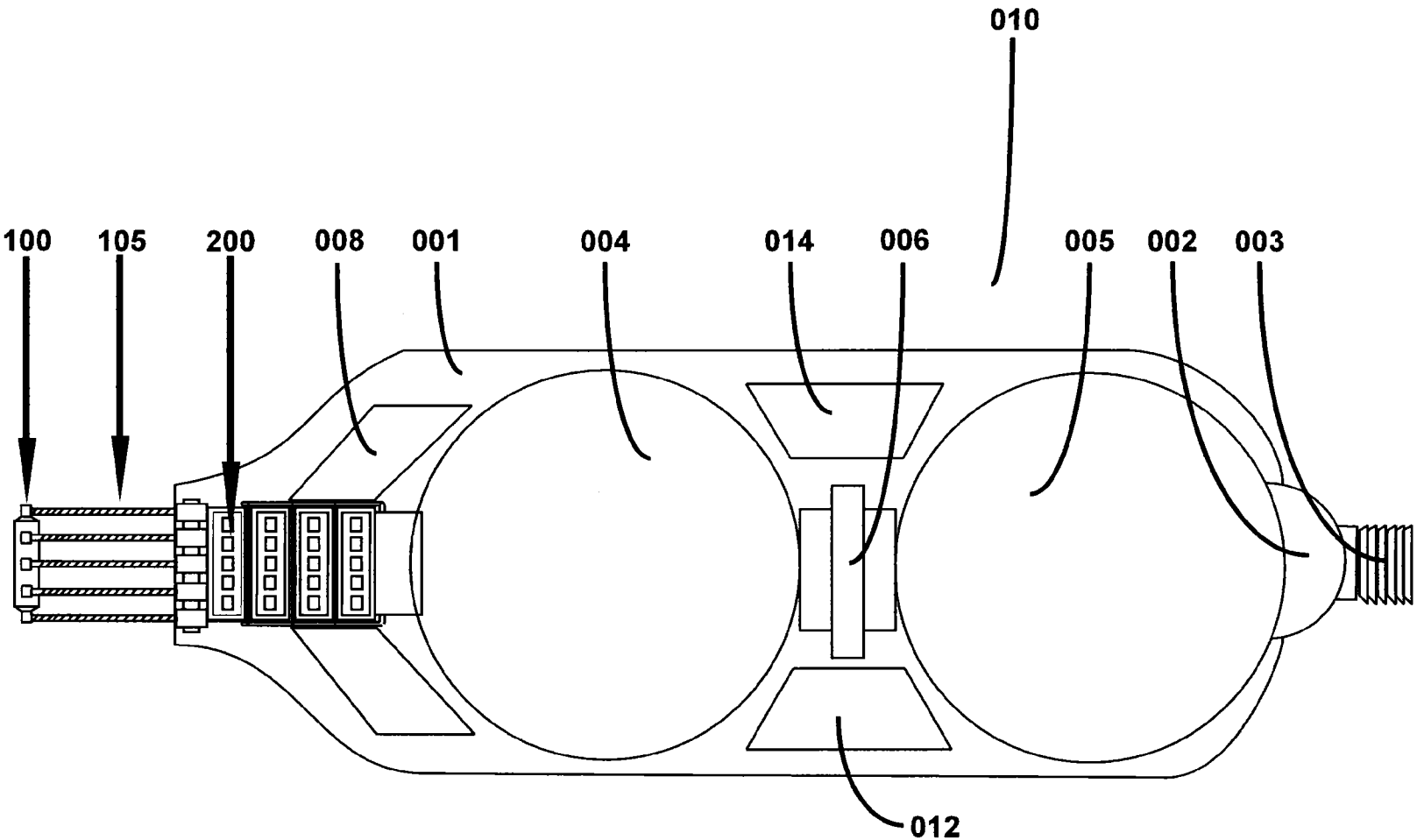
FIG. 1 is a cross section of the remotely operated underwater redirection plenum chamber for spill response.

In the following description, certain specific details are set forth in order to provide a thorough understanding of various embodiments of the invention. However, one skilled in the art will understand that the invention may be practiced without these details or with various combinations of these details. In other instances, well-known systems and methods associated with, but not necessarily limited to, blowout preventers, remotely operated underwater redirection plenum chamber's, underwater vessels and well drilling systems and methods may not be shown or described in detail to avoid unnecessarily obscuring descriptions of the embodiments of the invention.

A remotely operated underwater redirection plenum chamber, configured to affix itself to a riser pipe in order to contain and redirect oil for collection at the surface, is disclosed herein. In one embodiment, the redirection plenum chamber is designed to quickly move into position above a damaged riser pipe or wellhead and to capture leaking oil without a resulting increase in pressure in the well or riser, thus preventing conditions wherein the well or riser continues to degrade. In other words a benefit of the redirection plenum chamber is to vent the building pressure thereby protecting against fissures in the well riser that may cause uncontrollable seepage of oil in and through the seafloor. The ability to create a seal by fixation of the redirection plenum chamber without building the pressure within the pipe enhancing the probability of placement of a riser to the surface, thereby to facilitate a safe oil collection while preventing further release of oil. Use of the redirection plenum chamber, increases the likelihood of exploiting the integrity of the riser to collect oil while buying time to drill a relief well.

By way of example, once the redirection plenum chamber is in position over the riser pipe, the redirection plenum chamber is configured such that in response to received commands, actuators will lower an adjustable collar over a damaged riser pipe and then embed barbs within the collar allowing the redirection plenum chamber to fixedly grasp the riser forming a sealable connection. Once connected using the embedded barbs, a second actuator tightens a grip deforming the grip to extend inward to serve as a hydrostatic seal as it is secured around the pipe. The deformation of the grip to create a seal allows the flow of oil through the grip and onward through an orifice into the hull. In an embodiment, the redirection plenum chamber contains a blowout preventer to control the flow and pressure of the oil. A transfer hose is included for transferring oil from the hull to a surface vessel. Through its own onboard propulsion and ballast tanks the redirection plenum chamber may counter any currents or pressures and stay aligned with the pipe without putting additional pressure on the pipe or the well that may cause additional damage.

Another embodiment of the present invention relates to a system and method for sealing the riser pipe. By way of example, in an embodiment once the grip has created a seal between the riser pipe and the redirection plenum chamber, the second actuator continues to rotate further deforming the grip until it closes itself off, thereby stopping the fluid flow. In another embodiment, the blowout preventer within the redirection plenum chamber acts to stop the flow of oil.

FIG. 1 is a cross section of the redirection plenum chamber 10 for spill response. The redirection plenum chamber 10 consists of an external pressure hull 001. The hull 001 is capable of withstanding water pressure at ocean depths and is constructed out of any suitable metal such as high strength steel for the deepest applications or alternatively out of a lightweight aluminum for lesser depths. The selection of the material is not limited to metal but might be a metal and composite material or composite material or other suitable material based on required operating depths.

A control and dive unit 300 is rigidly connected to the outer hull 001 and is further described with respect to FIG. 5 below. The redirection plenum chamber 10 is preferably powered by either electromechanical generation means or a series of rechargeable batteries or the two working in conjunction. The redirection plenum chamber 10 might alternatively be wired to a power supply on the surface. In some embodiments the redirection plenum chamber 10 is tethered to a surface ship during operation, while in other embodiments the redirection plenum chamber 10 is capable of receiving control signals from an onboard processor functioning autonomously.

The hull 001 defines at least a first inner pressure chamber 004 and a second inner pressure chamber 005. Additional inner pressure chambers may be optionally advantageous in some embodiments. The pressure hull 001 is configured to withstand pressures from oil and gas escaping the well. The first inner pressure chamber 004 and a second inner pressure chamber 005 are separated by a blowout preventer 006. The hull 001 at a first end further includes an attachment system 100 for grasping the well riser.

The attachment system 100 is optionally cylindrical in shape and is configured to detachably connect the redirection plenum chamber 10 to a riser and in conjunction with the riser, to create a sealed fluid connection between the redirection plenum chamber 10 inner pressure chamber 004 and the riser pipe. The attachment system 100 is described further below with reference to FIGS. 3A, 3B, and 3C. The attachment system 100 surrounds a grip 200.

The grip 200 is tubular in shape and is configured to, upon suitable deformation, to sealingly connect the first inner pressure chamber 004 with the riser pipe. The grip 200 surrounds an outer diameter of the riser causing the fluid, under its own pressure within the riser, to flow through the grip 200. As described with reference to FIG. 4, below, the grip 200 includes a plurality of counter rotating rings 201 and each counter rotating ring 201 connected by a seal, thus creating a hydrostatic seal. As the grip rings rotate, the distal end of the grip creates a sealing gasket within the ring around the outer diameter of the riser pipe, thus allowing oil and gas to flow from the riser pipe into the redirection plenum chamber 10 inner pressure chamber 004.

At a second end of the hull 001 a connection sphere 002 serves as a conduit venting the second pressure chamber 005 to a temporary riser such as an exemplary transfer hose 003 depicted in FIG. 1. The connection sphere 002 is sealingly connectable to the transfer hose 003 in a manner that allows for the flow of fluid from the second inner pressure hull 005 through the connection sphere 002 through the transfer hose 003.

The hull 001 further contains a mechanical and guidance package 12 which may be integrated with an electronics and control package 14 which in either a separated or integral unit are configured to operate the blowout preventer 006 and the attachment system 100, as well as provide for the overall navigation of the redirection plenum chamber. As indicated above, these units may function in response to signals from the surface or may be configured to work autonomously. The selection of a particular electronics and control package 14 is not within the ambit of the invention but rather it is acknowledged that some such means are necessary to suitably affect the ends of the invention. Thus the electronics and control package may optionally be configured to be connected to a controller located apart from the redirection plenum chamber 10 or to function autonomously. The redirection plenum chamber 10 is configured to operate in a tethered and wired connection to a surface vessel.

Figure 2:
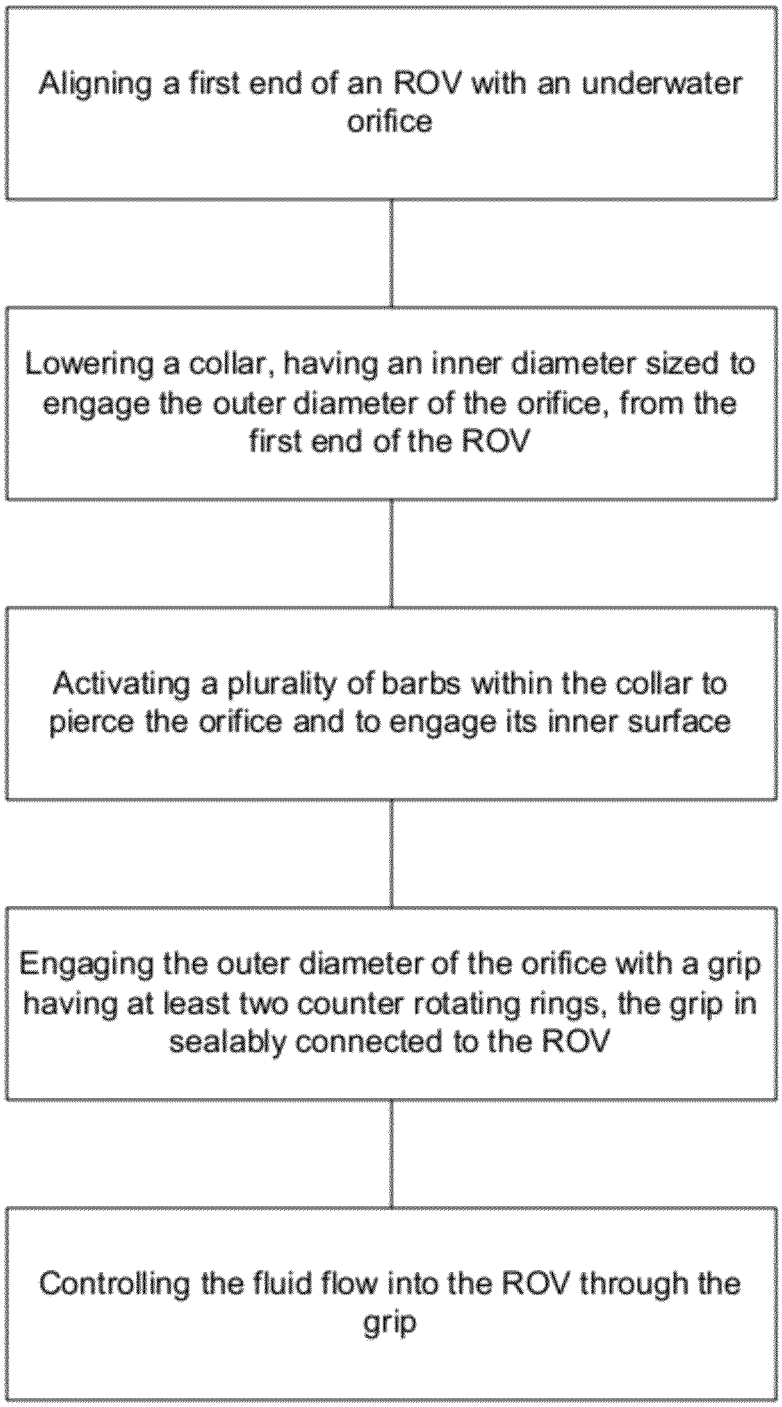
FIG. 2 is a flowchart showing a method for operating the remotely operated underwater redirection plenum chamber according to an embodiment of the invention.

FIG. 2 is a flowchart showing a method 20 for operating the redirection plenum chamber according to an embodiment of the invention. In response to an underwater fluid flow, and embodiment of the redirection plenum chamber described herein is launched and is directed to an underwater location. At step 23 the redirection plenum chamber aligns a first end of the redirection plenum chamber with a riser pipe having fluid flow. At step 27, once the first end of the redirection plenum chamber is aligned over the riser pipe, the attachment system of the reduction plenum chamber is lowered to the riser pipe. Importantly, the redirection plenum chamber is configured to vent pressure from the flow from the riser at this step, allowing accurate positioning.

At step 24, a collar, located on the distal end of a plurality of drive arms and at a proximal end to the drive system, surrounds the outer diameter of the riser pipe. In alternate embodiments the redirection plenum chamber itself using a propulsion system lowers the attachment system onto the riser pipe. The collar is sizeable such that the inner diameter of the collar is adjusted to grasp the outer diameter of the pipe; the collar further contains a plurality of explosively charged barbs.

At step 26, the explosively charged barbs are activated such that they pierce the riser pipe and engage an inner surface of the riser pipe. Upon piercing the riser, the barbs fixedly hold the redirection plenum chamber to the riser. The barbs are configured to include individual gaskets to engage the pipe and, using each gasket, to seal a hole resulting from the piercing action of the barbs, to ensure fluid does not flow through the holes made by the barbs. Because of mechanical connection the barbs afford, the riser is affixed to a collar, which, in turn, creates an attachment for the redirection plenum chamber, thereby allowing the drive system to pull the redirection plenum chamber further onto the riser. The drawing action of the redirection plenum chamber lowering it onto the riser is optionally enhanced using the redirection plenum chamber's propulsion system to the lower the redirection plenum chamber onto the riser pipe.

The outer diameter of the pipe is then engaged by a grip at step 28. The grip comprising at least two counter rotating cylinders, each cylinder is separated by a pressure seal, such that when counter rotated, the cylinder grip the riser pipe. In response to a signal from an electronics and control package, and actuator rotates the grip deforming the grip inwardly such that a seal develops around the contacted surface riser pipe and around an access to the first inner hull, thus creating a flow of the fluid between the riser pipe and the redirection plenum chamber. The redirection plenum chamber them may optionally regulate, such as by using an optional blowout preventer, or vents the flow of the fluid between the first inner hull and the second inner hull, and ultimately through the surface of the transfer hose.

FIG. 3A is a view of an attachment system 100 according to an embodiment of the invention. The attachment system 100 is flexibly attached to the hull of the redirection plenum chamber and is generally cylindrical and is sized to surround the riser pipe. The cylindrical attachment system 100 includes an activator to selectively extend or retract a series of drive arms 105 in concert with a series of drive cylinders 104 mounted circularly around the actuator to form a drive system 103. The drive arms 105 are preferably threaded and surrounded by a cylinder 104. The drive cylinder 104, when rotated, causes the drive arms 105 to extend or retract. The drive arms 105 are rigidly connected to a collar 101 at the drive arms 105 distal end.

The drive system 103 may be an electric gear drive 107 or alternatively a hydraulic system or other mechanical system to selectively extend and retract the drive arms 105. In one such embodiment, the drive system 103, having a plurality of drive cylinders 104, surrounds a plurality of drive arms 105. The drive arms 105 are threaded such that when the drive cylinder 104 rotates the drive arm 105, the drive arms 105 extend or retract in response to the rotation, as shown in FIG. 3B. The drive arms 105 pivotally terminate at the collar 101.

FIG. 3C is an overhead view of a collar 101 according to an embodiment of the invention. The collar 101 is configured to be connected to the plurality of drive arms 105. The collar 101, has a variable internal diameter that can be adjusted based on the outer diameter of the riser pipe. The collar 101 further includes a plurality of barbs 109 as shown in FIG. 3D. The barbs 109 having a sharp tipped head shaped in a manner that allows the head to penetrate the riser pipe and further having spikes that expands once the tip penetrates the pipe to prevent the tip from sliding out. The barbs 109 further comprising a rubber washer to prevent the seepage of fluid after the pipe has been punctured.

Figure 4:
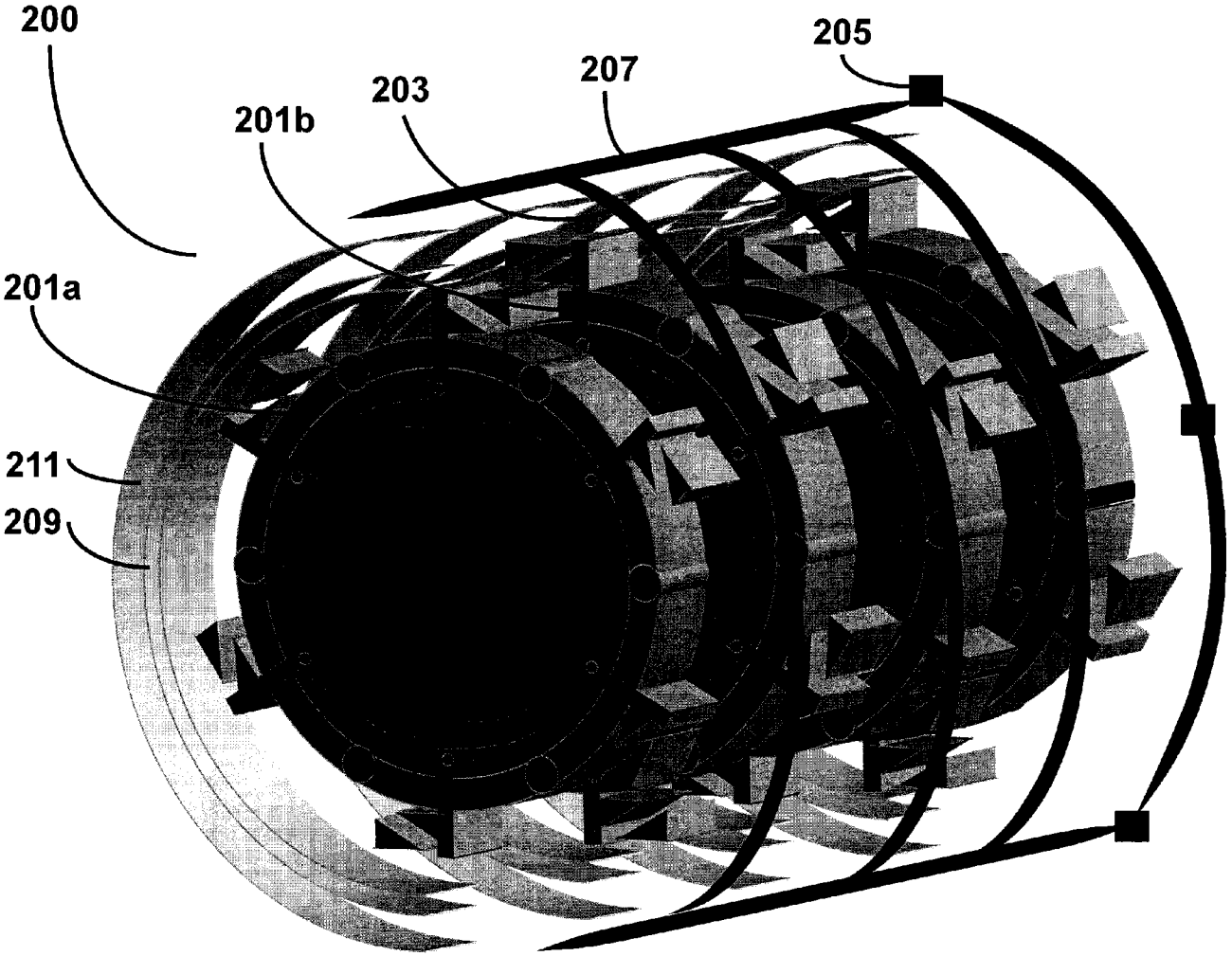
FIG. 4 shows an exploded view of a grip according to an embodiment of the invention.

FIG. 4 shows an exploded view of a grip 200 according to an embodiment of the invention. The grip 200 is configured with at least two connection rings 201*a*, 201*b*, and the connection rings 201*a*, 201*b* rotatably connected by a plurality of pressure seals 203. The pressure seals 203 attached to a seal pump 205 through seal pump lines 207. Each of the connection rings 201 having connection ring drive gears 209 which are then connected to a drive engine 211. The connection rings 201 having a first connection ring at a first end further including serrated teeth (not shown) for connection to a riser pipe. A second end of the connection rings 201 sealably connected to an orifice of the hull. The connections rings 201 are configured to counter rotate, thus creating a hydrostatic seal.

Figure 5:
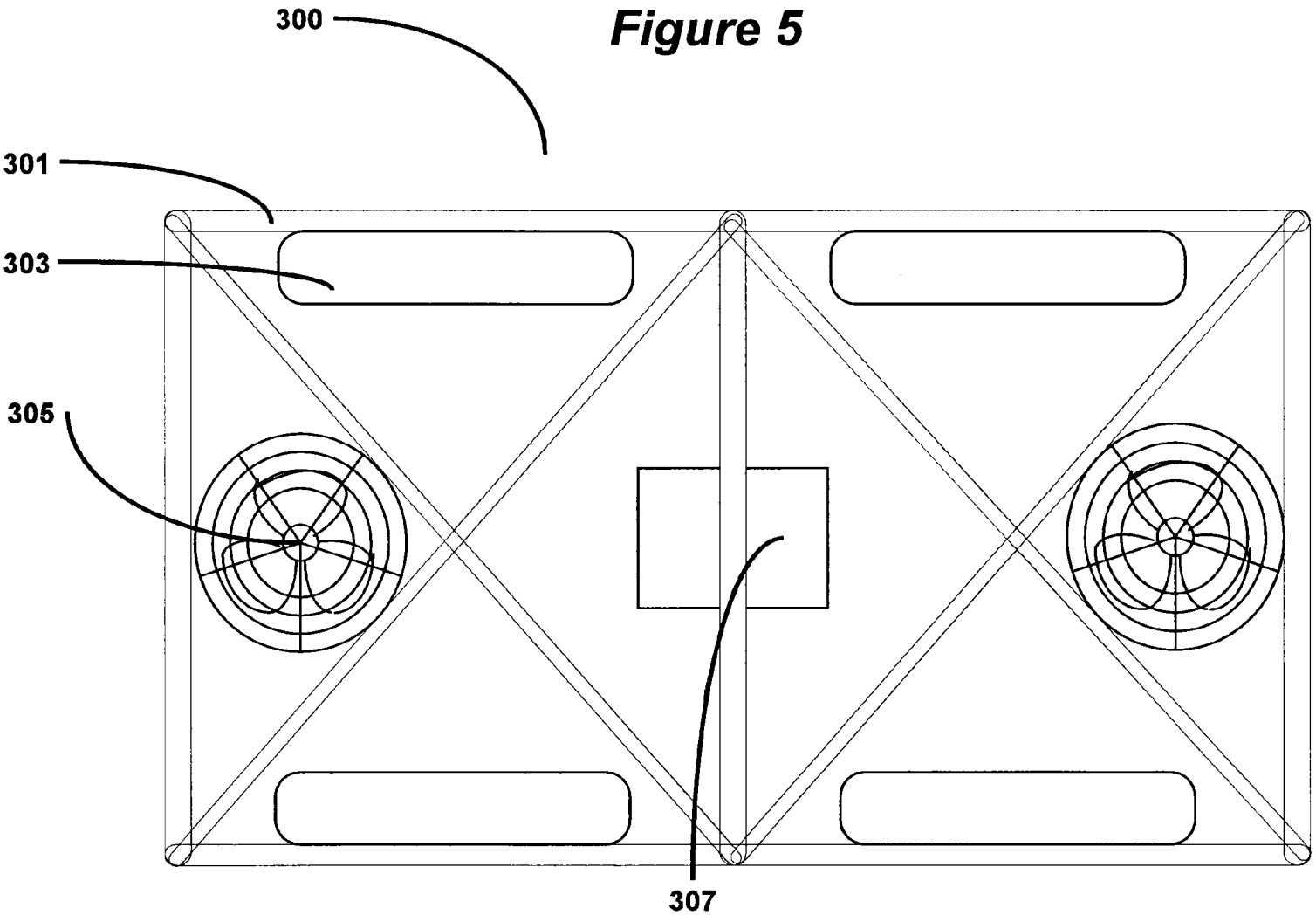
FIG. 5 shows a schematic view of a propulsion unit according to an embodiment of the invention.

FIG. 5 shows a schematic view of a propulsion unit 300 according to an embodiment of the invention. A propulsion unit 300 includes multidirectional propellers 305, and ballast tanks 303, contained within a frame 301 which is used to align the device with the riser pipe. The propellers 305 are configured to counteract the currents when the attachment system 100 is connected to the pipe.

While the preferred embodiment of the invention has been illustrated and described, as noted above, many changes can be made without departing from the spirit and scope of the invention. In alternate embodiments the attachment system as described herein may be attached to surface vessels, or fixed structures either above or below water. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A method for operating an underwater redirection plenum chamber comprising:

encompassing an outer surface of a riser pipe generally at an upper end with a collar from a first end of the redirection plenum chamber, such that an inner surface of the collar surrounds the outer surface of a riser pipe having a fluid flow;

activating a plurality of barbs within the collar to pierce the riser pipe generally at the upper end fixating the collar relative to the upper end of the riser pipe; and sealingly engaging the outer diameter of the riser pipe by urging an inner surface of a grip into contact with the outer surface of the riser pipe generally at the upper end, the urging of the grip occurring by compression exerted by at least two counter rotating cylinders engaged by a threaded coupling.

2. The method of claim 1 wherein the step of encompassing an outer surface of the riser pipe further comprises:

selectively admitting sea water into at least one ballast tank; and selectively activating a propulsion system such that the redirection plenum chamber is capable of compensating for currents.

3. The method of claim 1 wherein the step of encompassing the outer surface of the riser pipe further comprises activating a gear drive system configured to interact with a plurality of drive arms.

4. The method of claim 1 wherein the step of encompassing the outer surface of the riser pipe further comprises activating a hydraulic system to interact with a plurality of drive arms.

5. The method of claim 3 further comprising: activating the drive system to lower the redirection plenum chamber to the riser pipe.

6. The method of claim 1 further comprising: regulating a flow oil from the riser pipe between a first chamber the plenum defines and a second chamber the plenum defines, communication between the first chamber and the second chamber being regulated by a blowout preventer panel, such that a constant pressure is maintained.

7. The method of claim 1 further comprises attaching a first end of a hose to the second inner pressure chamber where the attachment allows fluid to flow through the hose.

8. A redirection plenum chamber comprising:

a hull; and a cylindrical attachment system flexibly coupled to a first end of the hull, the attachment system further comprising:

an actuator defined by the attachment system configured to selectively extend or retract a plurality of drive arms in concert with a plurality of drive cylinders mounted circularly around the actuator to form a drive system;

a collar rigidly connected to a distal end of the at least one of the plurality of drive arms, the collar comprising a plurality of explosively activated barbs; and a grip surrounded by and mounted within the attachment system and comprising a conduit having an interior passage to provide fluid communication between the collar and a first inner pressure chamber the hull defines, the grip includes an annular seal concentrically arranged between at least two counter rotating cylinders threaded engagement with the conduit, configured to, upon counter rotation to suitably deform the annular seal to sealingly connect the hull with a riser pipe generally at its upper end.

9. The redirection plenum chamber of claim 8, wherein the hull further defines a second inner pressure chamber fluidly connected through a blowout preventer such that a fluid may travel from the first inner pressure chamber to the second inner pressure chamber.

10. The redirection plenum chamber of claim 8 wherein the collar is rigidly connected to a terminal end of the plurality of drive arms.

11. The redirection plenum chamber of claim 8 wherein the explosively activated barbs further comprise a gasket configured to seal a hole opened in the riser pipe upon activation of the explosively activated barbs.

12. The redirection plenum chamber of claim 8 wherein the grip further comprises a grip distal end having and inner diameter with serrated teeth configured to grasp a riser pipe.

13. The redirection plenum chamber of claim 12 wherein the annular seal further comprises a plurality of pressure seals located between at least two counter rotating cylinders and is in fluid communication with a seal pump.

14. The redirection plenum chamber of claim 13 wherein the counter rotating cylinders further comprises a series of drive gears along its outer surface, configured to interact with a drive engine.

15. The redirection plenum chamber of claim 14 wherein the drive system is a gear drive system.

16. The redirection plenum chamber of claim 14 wherein the drive system is a hydraulic drive system.

17. A system for use in connecting an underwater riser pipe to a redirection plenum chamber comprising:

an adjustable collar, configured such that in response to a first received command, a first actuator positions the adjustable collar to encompass a riser pipe in the general location of an upper end and an in further response to a second received command, embeds barbs within the collar into the pipe to fixedly locate the collar relative to the riser pipe and in response to a third received command to draw the riser pipe at the general location of an upper end into the chamber; and a grip connected to a first end of the redirection plenum chamber, configured such that in response to received commands a second actuator rotates counter rotating cylinders to deform an annular seal to extend inward to sealingly engage the riser pipe at generally its upper end, allowing the flow of oil through the grip and onward through an orifice a hull of the redirection plenum chamber defines.

18. The system of claim 17 wherein the embedded barbs are configured to explosively thrust into the riser pipe at generally its upper end.

19. The system of claim 17 wherein the hull further defines first and second inner pressure chambers which allow fluid communication through a blowout preventer to control a flow rate and pressure of the oil fluid.

20. The system of claim 17 wherein the second inner pressure chamber admits oil fluid into a transfer hose detachably attached thereto.

21. The system of claim 17 wherein the redirection plenum chamber further comprises a propulsion and ballast system mounted externally on the redirection plenum chamber to align the redirection plenum chamber with the riser pipe at generally its upper end.

* * * * *